US005381678A

United States Patent [19]

Chiang

[11] Patent Number: 5,381,678

[45] Date of Patent: Jan. 17, 1995

[54] FLUID FLOW TYPE DYEING APPARATUS

[76] Inventor: Chao-Cheng Chiang, 5F-2, No. 455, Chung Cheng Road, Yung-ho City, Taipei Hsien, Taiwan, Prov. of China

[21] Appl. No.: 209,034

[22] Filed: Mar. 9, 1994

[51] Int. Cl.[6] ..... D06B 3/28

[52] U.S. Cl. ..... 68/177

[58] Field of Search ..... 68/177, 178

[56] References Cited

U.S. PATENT DOCUMENTS

| | | | |
|---|---|---|---|
| 3,949,580 | 4/1976 | Trullas | 68/177 |
| 3,982,411 | 9/1976 | Kreitz | 68/177 |
| 4,578,085 | 3/1986 | Ishimaru | 68/177 X |
| 4,977,761 | 12/1990 | Hacker et al. | 68/177 |
| 5,299,339 | 4/1994 | Georgantas | 68/177 X |

FOREIGN PATENT DOCUMENTS

| | | | |
|---|---|---|---|
| 2659093 | 9/1991 | France | 68/177 |
| 1384638 | 3/1988 | U.S.S.R. | 68/178 |

*Primary Examiner*—Philip R. Coe

*Attorney, Agent, or Firm*—Pro-Techtor International

[57] ABSTRACT

A fluid flow type dyeing apparatus includes a dyeing bath and a fluid flow tube. The fluid flow has a front end to which a jet nozzle is mounted. The dyeing bath is in fluid connection with the fluid flow tube and the fluid flow tube is disposed in an inclined manner to allow the dye fluid that is sprayed from the jet nozzle onto an object to be dyed to move the object along the inclination of the fluid flow toward the dyeing bath and the dye fluid is drawn and pumped again to the jet nozzle to be recycled. The fluid flow tube has secured to an axially-oriented tube wall thereof a dye tube. A plurality of secondary nozzles which are spaced at suitable interval are arranged on the tube wall between the fluid flow tube and the dye tube to spray the dye fluid of the dye tube into the fluid flow tube toward downstream direction thereof so as to form high speed flow on lower portion inside the fluid flow tube and provide the object to be dyed and the dye fluid inside the fluid flow tube with an additional driving force by the high speed fluid flow for achieving increase in moving speed and enhancement in dyeing effectiveness.

2 Claims, 8 Drawing Sheets

PRIOR ART FIG. 1

FLUID FLOW TYPE DYEING APPARATUS

FIELD OF THE INVENTION

The present invention relates to a fluid flow type dyeing apparatus and in particular to an improvement thereof capable to increase the speed inside the fluid flow tube so that in the dyeing operation of the dyeing apparatus, the moving speed of dye fluid and the object be dyed can be increased and the dye can be effectively stirred to enhance the relative movement between the dye and the fabric and thus increasing the absorbability of the dye by the fabric so as to enhance dyeing effectiveness of the fluid flow dyeing apparatus.

BACKGROUND OF THE INVENTION

In general, a conventional fluid flow type dyeing machine generates dye jets by means of jet nozzles or other devices to force the dye fluid and the object to be dyed to circulate and dyed in a high temperature, high pressure condition. The conventional dyeing machines has two categories, high temperature, high pressure type and room temperature, atmosphere pressure type. The conventional fluid flow type dyeing machine comprises a closed dyeing bath, a fabric guiding wheel, a jet nozzle, a fluid flow tube, a heat exchanger for temperature control and a dye circulation pump wherein, except in the rotary type dyeing machines, the fluid flow tube is in general disposed above the dyeing bath along the axial direction thereof with the jet nozzle located at the front end of the inlet opening of the fluid flow tube, the fluid flow tube being connected to the ends of the dyeing bath with the front and rear ends thereof, the fabric guiding wheel escorting the object to be dyed in the front end of the dyeing bath to approach the jet nozzle during the operation of the dyeing machine so as to allow the fluid flow formed by the dye jet from the jet nozzle or other means to force the dye fluid and the object to be dyed to move through the fluid flow tube to enter the rear end of the dyeing bath, the dye and the object to be dyed within the dyeing bath being driven forward by the dye flow that is sucked into the circulation pump from the front bottom side of the dyeing bath so as to circulate and conduct dyeing at the same time, the dye flow that enters the circulation pump being forced by the circulation pump to flow through the heat exchanger to increase or decrease the temperature thereof and then transmitted to the jet nozzle to form dye jet. Such a fluid flow dyeing machine, as shown in FIG. 1, comprises in general a closed dyeing bath 1 and a fluid flow tube 2. The fluid flow tube 2 has mounted at an end thereof a jet nozzle 20 and an opposite end thereof in fluid communication with the dyeing bath 1, the tube 2 being disposed in an inclined manner to help the dye inside the fluid flow tube 2 to flow back to the dyeing bath 1. The dye inside the dyeing bath 1 is forced toward the jet nozzle by means of a circulation pump so as to form fluid flow and to provide higher concentration dye fluid. When the object to be dyed 22 enters the fluid flow tube 2 through the end thereof that has the jet nozzle 20 mounted thereon, the jet nozzle 2 sprays dye to the object 22 which will then move through the fluid flow tube 2 by the impulsive force of the dye jet from the jet nozzle and the inclination of the fluid flow tube back into the dyeing bath 1 to dip into dye fluid and then escorted by the fabric guiding wheel 12 toward the jet nozzle 20 to be cyclically and repeatedly dyed. Since the movement of the object to be dyed 22, namely the moving speed thereof, is controlled by the dye jet provided by the jet nozzle 20 which drives the object to be dyed 22 to move forward, the jet nozzle 20 must has a great jet impulse for moving the object to be dyed 22. However, a jet impulse that is great will tend to damage the regularity of fiber arrangement of the fabric and the great jet impulse usually causes the formation of small "fiber balls" on the surface of the object to be dyed 22. This deteriorates the quality of the dyed fabric. On the other hand, reducing the jet impulse leads in insufficient penetration of the dye into the fabric and slowing down the movement of the object to be dyed which sometimes causes an out-of-phase condition between the fabric guiding wheel 12 and the jet nozzle 20 and thus leading in stop and accumulation of the object to be dyed which forces the machine to be shut down and thus lowering the productivity. Besides, since in such a conventional dyeing machine, the dye is only sprayed to the object to be dyed once by means of the jet nozzle 20, it takes longer time to sufficiently dye the object and the dyeing effectiveness thereof is not good enough.

Due to the above disadvantages, it is desirable to provide a fluid flow type dyeing apparatus which overcomes the deficiencies of the conventional devices, not only enhancing the quality of the dyed fabric, but also heightening the dyeing efficiency.

SUMMARY OF THE INVENTION

It is therefore the principle object of the present invention to provide a fluid flow type dyeing apparatus which has secondary dye jet nozzles disposed therein to increase the effective surface area of the fabric acted upon by dye jets so that the moving speed will not be limited by the impulse of the dye jet from a single jet nozzle, namely the moving speed of the fabric to be dyed may be arbitrarily selected for heightening the dyeing efficiency.

It is another object of the present invention to provide a fluid flow type dyeing apparatus which enhances the effectiveness of dye spraying so as to heighten the dyeing quality of the dyed fabric.

To achieve the above-mentioned objects, the present invention provides a fluid flow dyeing apparatus generally comprising a dyeing bath, a fluid flow tube and a circulation pump. The fluid flow tube has a front end with a jet nozzle mounted thereon. The dyeing bath and the fluid flow tube are connected to each other to form a closed fluid loop. The circulation pump is connection to the closed fluid loop by piping to draw in dye fluid from the closed fluid loop, pressurizing the dye fluid and transmitting the dye to the jet nozzle to be sprayed out therefrom. The fluid flow tube is disposed in an inclined manner so that the dye that is sprayed to the object to be dyed flows along tile inclination of the fluid flow tube and drives the object to be dyed forward to move into the dyeing bath and is drawn and transmitted to the jet nozzle by the pump for cyclic usage. The fluid flow type dyeing apparatus of the present invention is characterized in that a dye tube is provided to be juxtaposing to and connected to the fluid flow tube to form a passage for pressurized dye fluid supplied by the pump, having a plurality of dye nozzles disposed in a spaced manner on the partition wall between the fluid flow tube and the dye tube to allow the dye inside the dye tube to be spray into the fluid flow tube toward the downstream direction thereof. Thus, high speed fluid flow is formed on the lower portion inside the fluid flow tube to provide an additional driving force to the dye and the object to be dyed inside the fluid flow tube so as to increase the moving speed and enhance the dyeing effectiveness.

BRIEF DESCRIPTION OF THE DRAWINGS

The above and other objects, advantages and features of the present invention will be readily apparent from the following description of a preferred embodiment taken in connection with the accompanying drawings, wherein.

DETAILED DESCRIPTION OF THE PREFERRED EMBODIMENT

Figure 1:
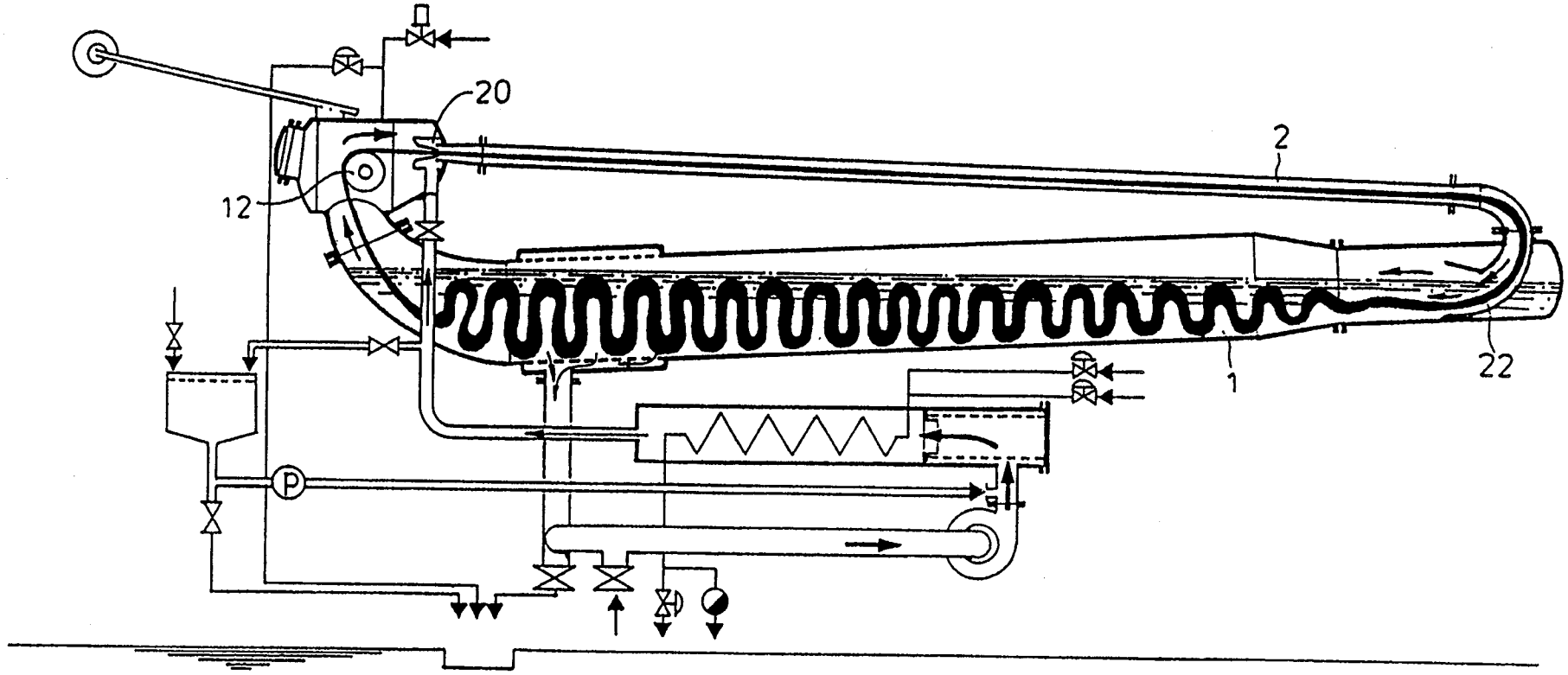
FIG. 1 shows a side elevational view of a conventional fluid flow type dyeing machine.
Figure 2:
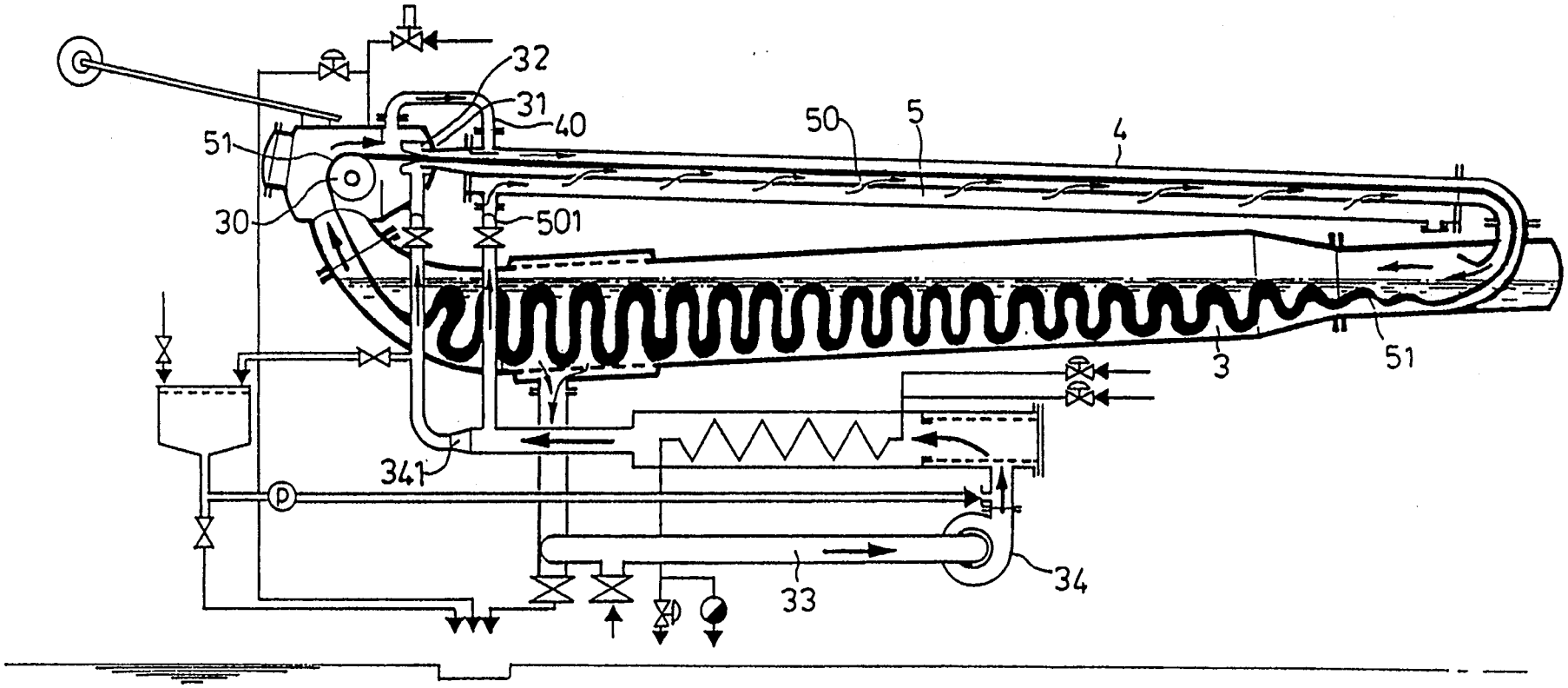
FIG. 2 shows a side elevational view of a fluid flow type dyeing apparatus constructed in accordance with the present invention.
Figure 3:
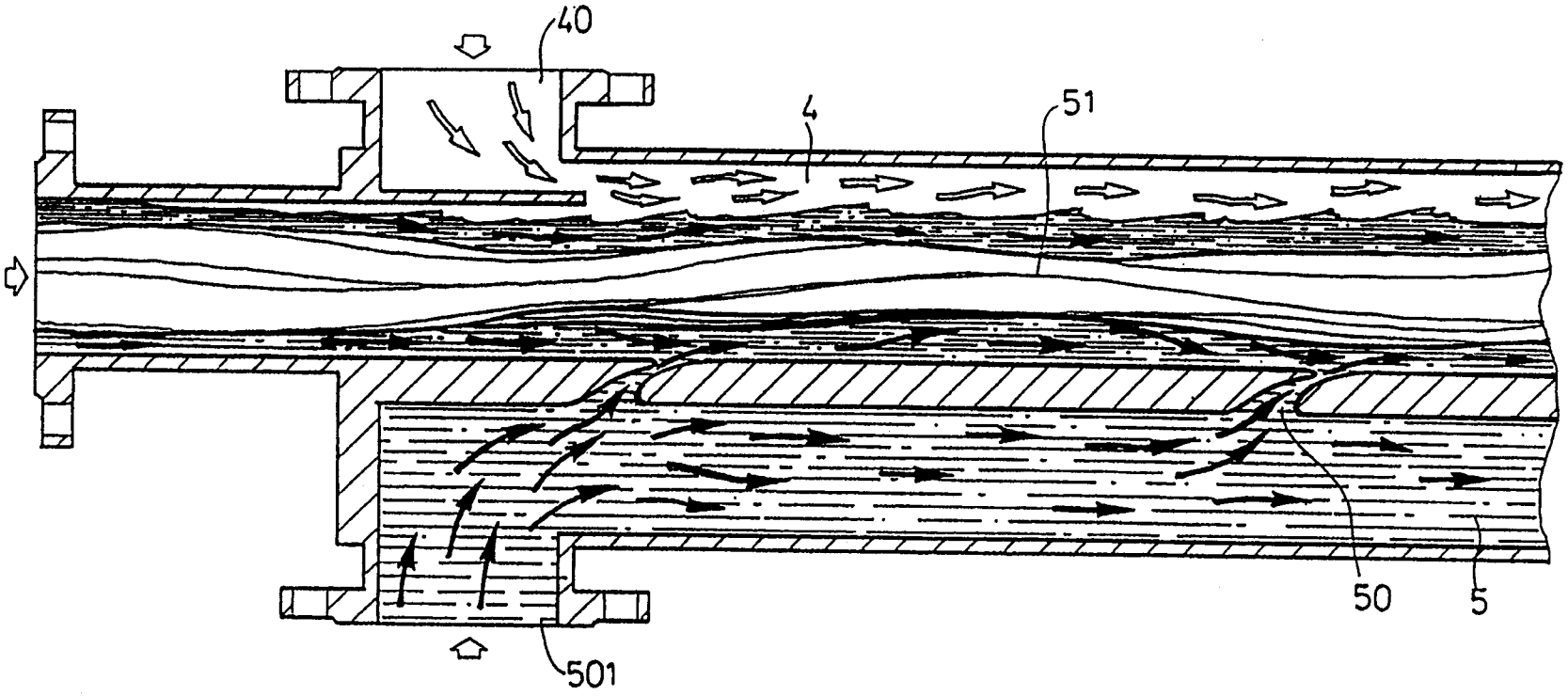
FIG. 3 shows a cross-sectional view of a portion of the fluid flow tube of the fluid flow type dyeing apparatus in accordance with the present invention.
Figure 4:
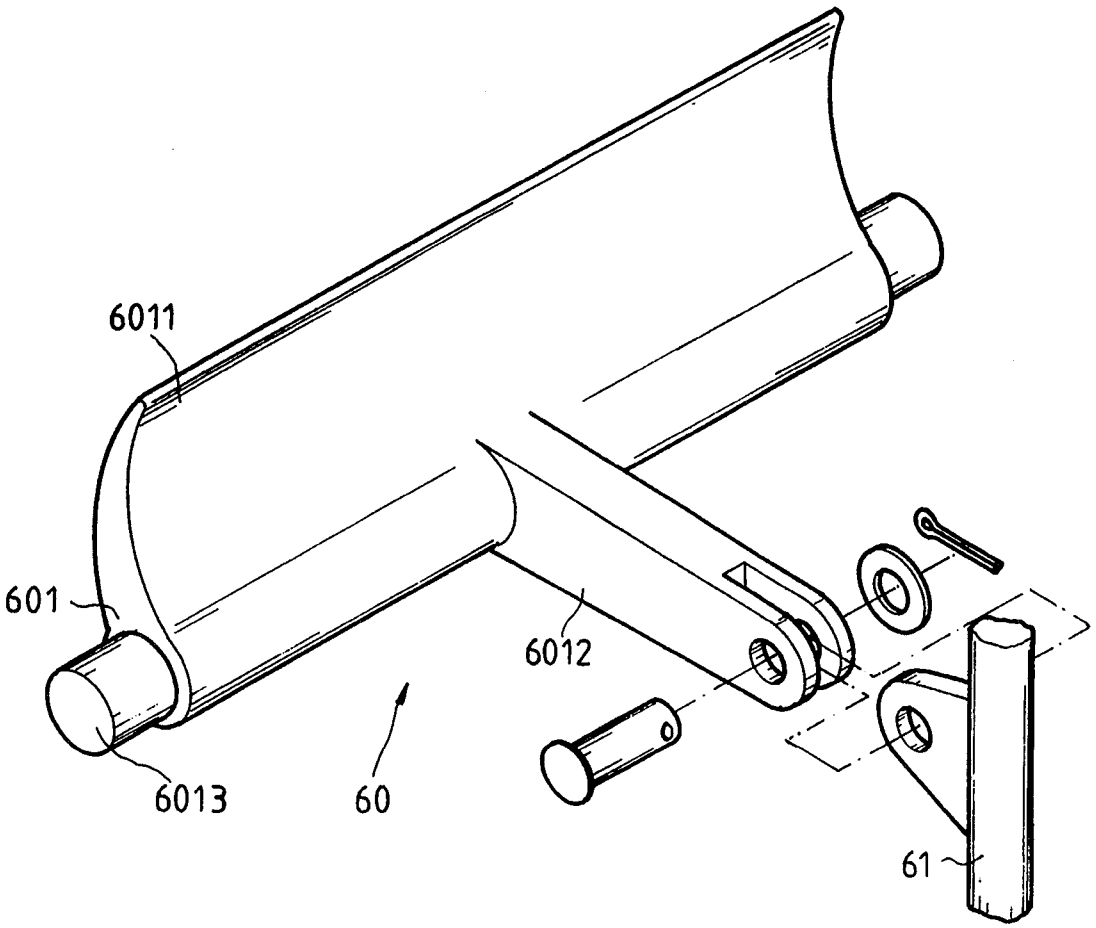
FIG. 4 shows a perspective view of a portion of the jet control device of the fluid flow type dyeing apparatus in accordance with the present invention.

With reference to FIGS. 2, 3 and 4, a fluid flow type dyeing apparatus constructed in accordance with the present invention generally comprises a dyeing bath 3, a fluid flow tube 4, a dye tube 5 and a jet control device 6.

The dyeing bath 3 comprises a generally tubular body, having at one end thereof a fabric guiding wheel 30 and an outlet opening 31. The fabric guiding wheel 30 escorts the object 51 to be dyed. The outlet opening 31 has a jet nozzle 32 mounted thereon. The dyeing both 3 has a return tube 33 disposed thereunder to allow the dye fluid to be returned to jet nozzle 32 for spraying via the return tube 33 and filter means and heat exchanger means by the pumping force of pump means 34. This is similar to the conventional fluid flow dyeing machine and thus no further discussion will be given.

The fluid flow tube 4 has an end connected to the outlet opening 31 of the dyeing bath 3 and an opposite end connected to another end of the dyeing bath 3 so that the fluid flow tube 4 and the dyeing bath 3 are in fluid connection and forming a closed fluid loop. The fluid flow tube 4 has mounted thereto in the proximity of the end thereof which is connected to the jet nozzle 32 an air tube 40 which is connected to the dyeing bath 3 to allow the air inside the dyeing bath 3 to flow into the fluid flow tube 4 for balancing the pressure inside the dyeing bath 3 and the fluid flow tube 4. The fluid flow 4 is disposed in an inclined manner to allow the dye inside the fluid flow tube 4 to flow along the inclination back into the dyeing bath 3.

The dye tube 5 is secured to the underside of the fluid flow tube 4 to extend along the axial direction thereof. The inlet opening 501 of the dye tube 5 is in fluid communication with the outlet port 341 of the pump means 34 to allow the dye which is pressurized by the pump means 34 to enter the dye tube 5. The dye tube 5 has a plurality of dye nozzles 50, in the form of an orifice formed on the tube wall of the fluid flow tube 4, disposed between the dye tube 5 and the fluid flow tube 4 along the axial direction at given interval so as to provide dye jets into the fluid flow tube 4 in a downstream direction and thus generating high speed fluid flows in the lower portion of the fluid flow tube 4. The high speed fluid flows provide an additional driving force to speed up the dye and object 51 inside the fluid flow tube 4 toward the downstream end thereof.

As a result, in the dyeing cycle, the object 51 is not only dyed by the dye jet provided by the jet nozzle 32 in the front end of the fluid flow tube 4, but also dyed by the dye jets provided by the dye nozzles 50 of the dye tube 5 during its downstream movement along the fluid flow tube 4. The dye jets generated by the dye nozzles 50 also serve to stir the dye inside the fluid flow tube 4 so as to cause the dye to deeply penetrate into the fibrous structure of the object 51 to more efficiently and more effectively dye the object 51. Further, under this condition, the jet nozzle 32 in the front end of the fluid flow tube 4 no longer needs to provide a great jet force for achieving an effective dyeing and consequently, the object 51 will not be damaged by the impulsive force of the dye jet from the jet nozzle 32 and no "fiber ball" will form on the fabric surface so that high quality of the dyed object 51 may be obtained. Besides, due to the impulsion of the dye jets from the dye nozzles 50 on the object 51 during the dyeing operation, the object 51 is moved in a fast speed and thus increasing the efficiency of dyeing and the productivity thereof.

Figure 5:
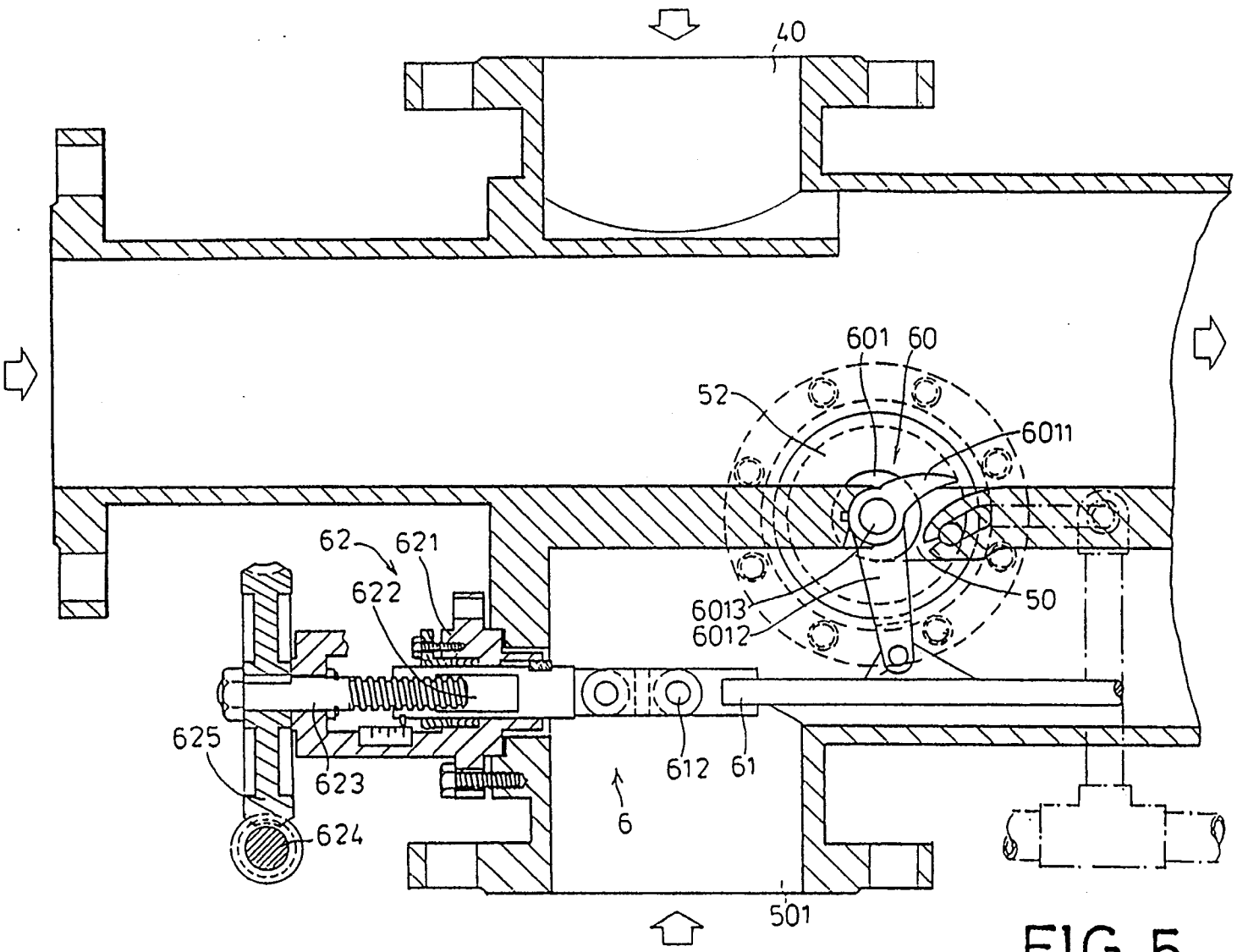
FIG. 5 shows a side elevational view, in a larger scale, of the jet control device of the fluid flow type dyeing apparatus in accordance with the present invention.
Figure 6:
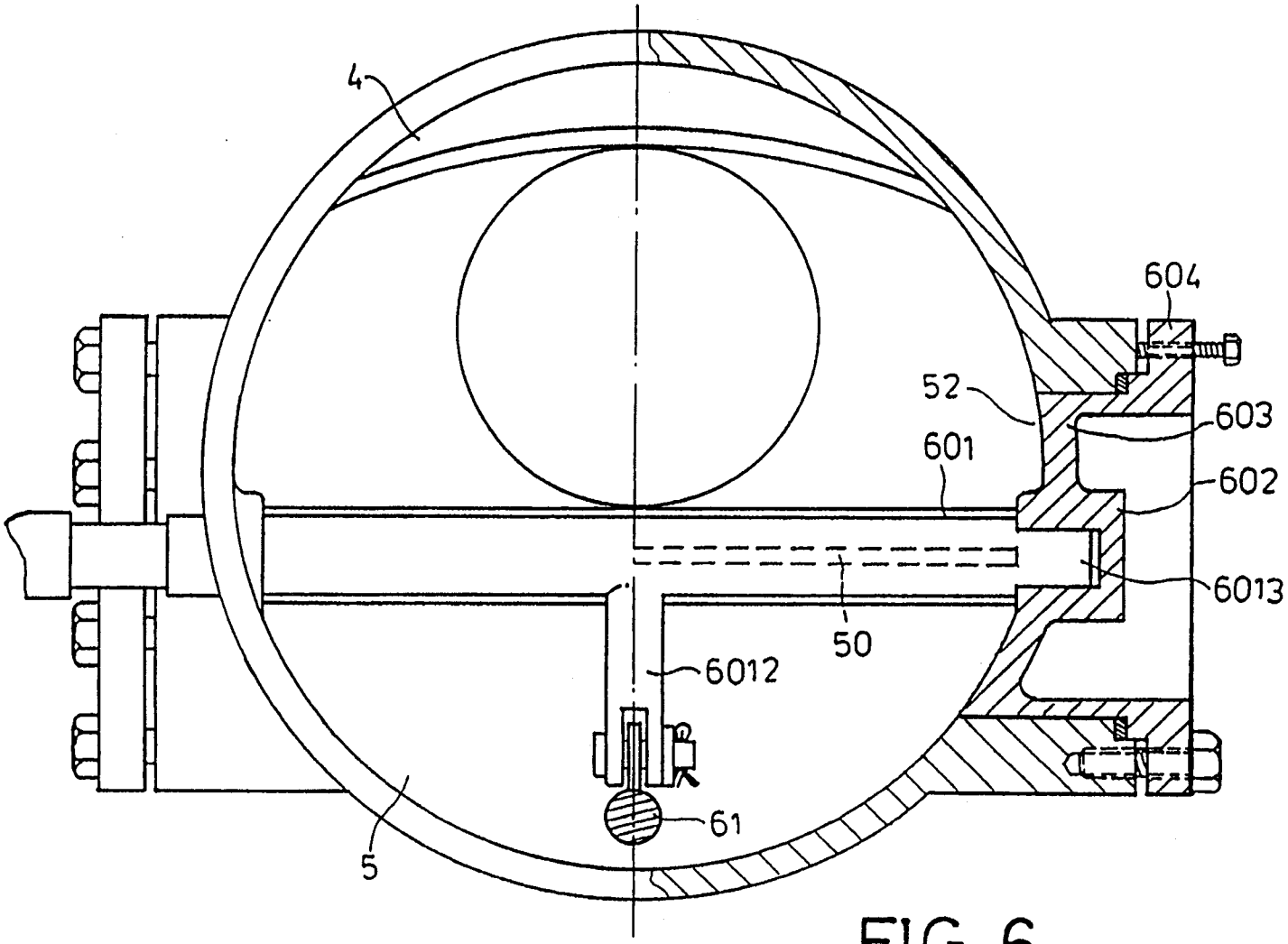
FIG. 6 shows a cross-sectional view of the jet control device of the fluid flow type dyeing apparatus in accordance with the present invention.

To control the dye jets from the dye nozzles 50, each of the dye nozzles 50 is provided with a jet control device 6 which is more clearly shown in FIGS. 4, 5 and 6. The jet control device 6 comprises generally a pivoting lever assembly 60, a driving link 61 and a control unit 62. The pivoting lever assembly 60 is mounted to the dye nozzle 50 with a direction control blade 6011 within the orifice of the jet nozzle 50 and in the proximity of the interior of the fluid flow tube 4 to adjust the opening size of the nozzle orifice 50. The pivoting lever assembly 50 comprises a shaft 601, bushings 602, caps 603 and retainer rings 604. The direction control blade 6011 is mounted to the shaft 601 to be rotatable in unison therewith. The shaft 601 also has a pivoting arm 6012 fixed thereon to rotate the shaft. The shaft 601 has two opposite ends each having a journal 6013 thereon to be rotatably supported by the bushings 602. In the embodiment illustrated, the caps 603 are respectively integrally formed with the bushings 602 as a single piece. Further, an observing hole 52 is formed on the fluid flow tube 4 and the dye tube 5 at the location of each of the dye nozzles 50 for monitoring and mounting the jet control device 6 inside the tubes. The retainer ring 604 is mounted on the hole 52 to close the hole 52 with the bushing 602 is fixed inside retainer ring 604. The pivoting arm 6012 of the shaft 601 is pivoted to the driving link 61 which extends inside and along the dye tube 5 in a substantially parallel manner. The driving link 61 has an end connected to the control unit 62 to be moved axially by the control of the control unit 62 to rotate the pivoting lever assembly 60 for adjusting the opening size of the nozzle orifice 50.

Figure 7:
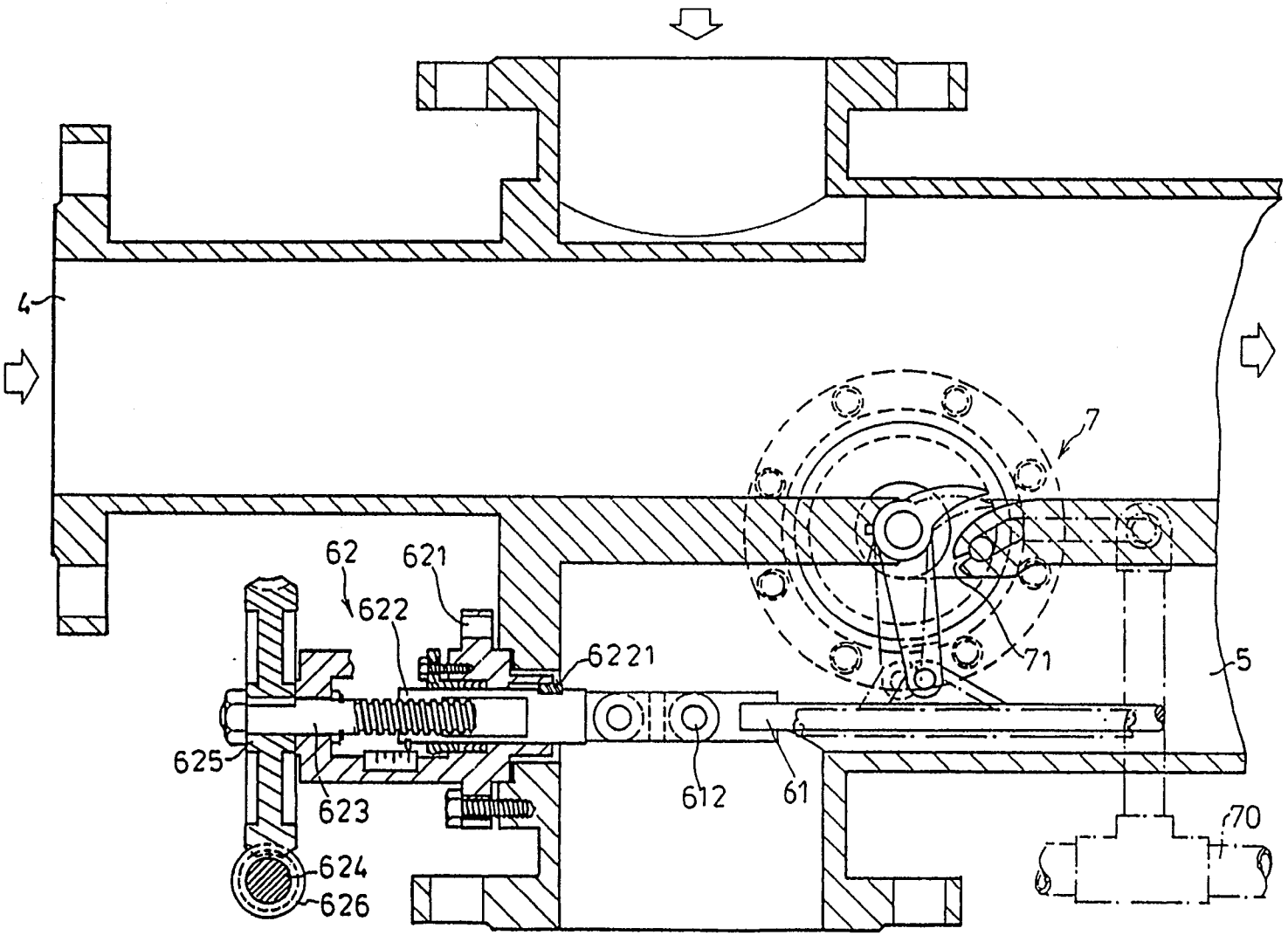
FIG. 7 shows the operation of the jet control device of the fluid flow type dyeing apparatus in accordance with the present invention.

With reference to FIG. 5, in the embodiment illustrated, the control unit 6 comprises a mount 621 which is fixed on an end of the dye tube 5, an inner-threaded rod 622 which extends through the mount 621 and axially movable relative to the mount 621 with an end thereof connected to the driving link 61 and an externally-threaded rod 623 which is threadingly engageably received within the inner-threaded rod 622 and is rotatable by a worm gear 625 which is in turn driven by a worm 624 so as to move the driving link 61 axially. A movable connector 612 is connected between the driving link 61 and the inner-threaded rod 622. Thus, referring to FIG. 7, to adjust the orientation of the shaft 601 of the pivoting lever assembly 60 for controlling the flow rate of dye through the orifice opening 50, a handwheel 626 which is secured to the worm 624 is rotated to rotate the worm 624 which in turn drives the worm gear 625 to have the externally-threaded rod 623 rotate relative to the inner-threaded rod 622 which is prevented from rotating by means of a key 6221 between the inner-threaded rod 622 and the mount 621 to move the inner-threaded rod 622 axially for moving the driving link 61 and thus rotating the shaft 601 of the pivoting lever assembly 60 so as to control the flow rate through the orifice 50. The control unit 62 is well known to those having ordinary skill so that no further detail will be given.

Thus, the flow rate of the dye nozzle 50 is adjustable by means of control unit 6 so that when the load induced by the object 51 inside the fluid flow tube 4 is increased and thus the moving speed is to increase, the flow rate of the dye nozzle 50 is increased and when the load of the object 51 is decreased and thus the moving speed thereof is to decrease, the flow rate of the dye nozzle 50 is reduced. The flow rate of the dye nozzle 50 is controlled by the control unit 6.

Moreover, the dye nozzle 50 is provided with a water sprinkler 7 on the downstream side of the flow of the fluid flow tube with the nozzle 71 thereof close to the entrance of the dye nozzle 50 for removing the fiber deposited on the dye nozzle 50 with water jet provided by a pressurized water loop 70.

The fluid flow type dyeing apparatus in accordance with the present invention provides the following advantages:

1. Enhancing the dyeing quality: since the fabric is not only dyed by the jet nozzle 32 of the dyeing bath 3, but also consistently dyed by dye jets from the nozzles 50 of the dye tube 5 which causes turbulence inside the fluid flow tube 4 to have the dye more uniformly penetrate into the fibrous structure of the fabric and thus enhancing the dyeing quality; furthermore, since the fabric may be further driven by the high speed flow in the lower portion of the fluid flow tube 4, the fabric may be moved at a substantial speed and effectively dyed even the jet nozzle 32 of the dyeing bath 3 does not provide a great impulsive force so that the fabric may not be damaged by the great impulsive force from the jet nozzle 32.
2. Increasing dyeing efficiency: since dye fluid is continuously sprayed from the dye nozzles 50 onto the fluid flow tube 4 when the fabric to be dyed is in movement, the dye on the lower portion inside the fluid flow tube 4 is propelled by the high speed flow which increases the moving speed of the fabric so as to increase the dyeing efficiency.
3. The opening size of the dye nozzles 50 is adjustable to control the flow rate of the dye sprayed out of the nozzles so as to be adaptable for fabric 51 of different loads.
4. The fluid flow tube of the present invention comprises dye nozzles 50 mounted thereto in the midway thereof, the dye jets thereof being provided by dye circulation pump wherein by the operation of the pump, energy of speed of the dye is converted to energy of pressure which will be in turn converted back into energy of speed by means of the nozzles to force the dye on the lower portion of the fluid flow to form high speed flow.

Figure 8:
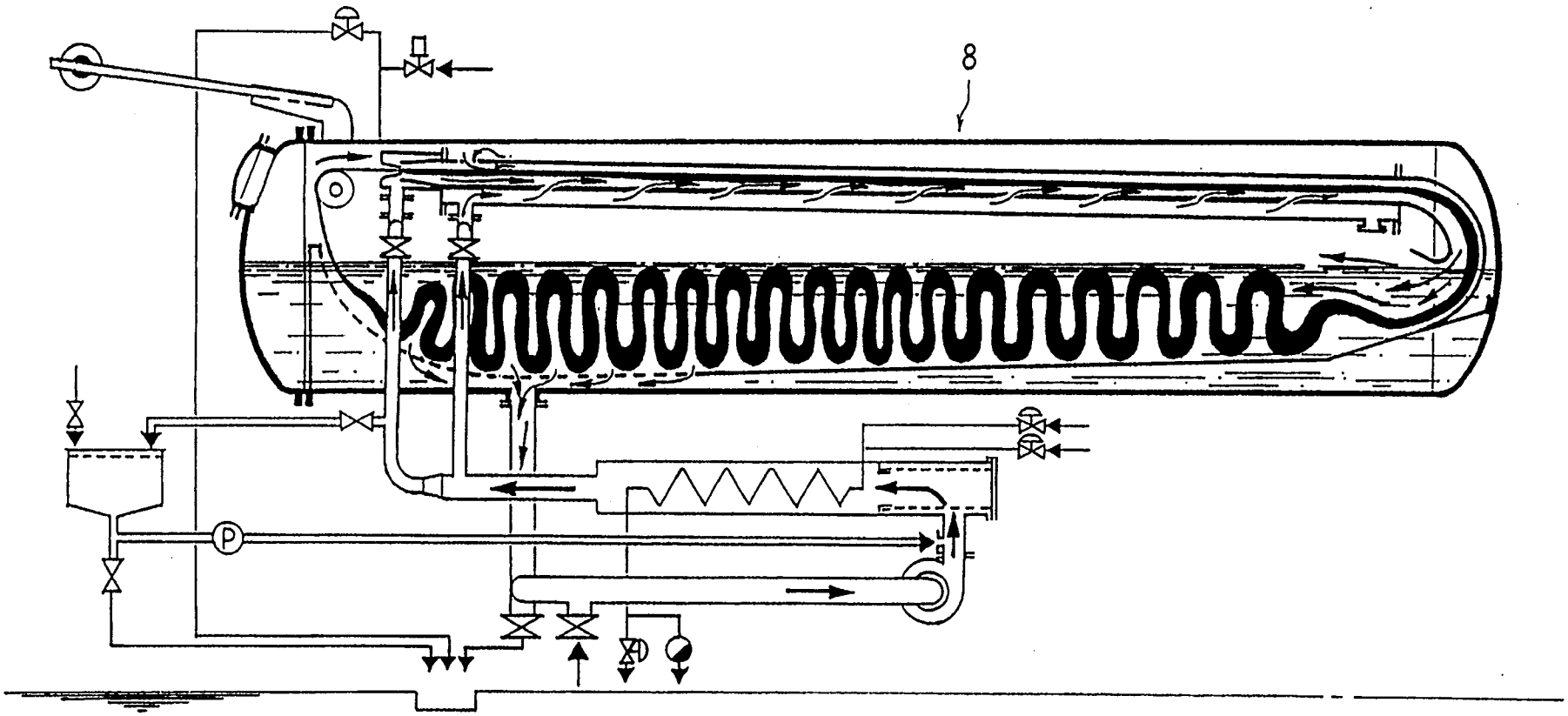
FIG. 8 shows another embodiment of the fluid flow type dyeing apparatus constructed in accordance with the present invention.

Another embodiment of the present invention is illustrated in FIG. 8. The features of the present invention can also be applied to other fluid flow tube of the same model.

It is apparent that although the invention has been described in connection with the preferred embodiment, it is contemplated that those skilled in the art may make changes to certain features of the preferred embodiment without departing from the spirit and scope of the invention as defined in the appended claims.

What is claimed is:

1. A fluid flow type dyeing apparatus comprising:

a dyeing bath, a fluid flow tube, and a circulation pump;

said fluid flow tube having a front end to which a jet nozzle is mounted;

said dyeing bath being connected to said fluid flow tube so as to form a closed fluid loop to which said circulation pump is connected via a piping system to draw dye fluid from the fluid loop, pressurizing and transmitting the dye fluid to said jet nozzle to have the dye fluid sprayed therefrom;

said fluid flow tube being disposed in an inclined manner to allow the dye fluid that is sprayed from the jet nozzle onto an object to be dyed to move said object along the inclined path of said fluid flow tube toward said dyeing bath, the dye fluid being drawn and pumped back to said Jet nozzle to be recycled;

the apparatus being characterized in that said fluid flow tube has secured to one side thereof a dye tube which extends along an axially-oriented tube wall thereof, said dye tube defining a passage for the pressurized dye fluid provided by the circulation pump, a plurality of secondary nozzles arranged on the tube wall between said fluid flow tube and said dye tube to spray the dye fluid of the dye tube into the fluid flow tube so as to form a high speed flow inside said fluid flow tube to provide said object and dye fluid inside said fluid flow tube with an additional driving force created by the high speed fluid flow to increase speed and enhance dyeing effectiveness;

the apparatus further comprising jet control means which comprises pivoting lever means, a driving link, and a control unit, the pivoting lever means being mounted to each of said secondary nozzles with the driving link which is movably disposed inside of and substantially parallel to said dye tube and is secured to one side thereof, said driving link having an end connected to said control unit so that by adjusting said control unit, said driving link is moved axially along the dye tube to rotate said pivoting lever means to control the opening size of the secondary nozzles.

2. The apparatus as claimed in claim 1 wherein:

the pivoting lever means of said secondary nozzles comprises a shaft, bushings, caps, and retainer rings, an observing hole being formed on a tube wall of said fluid flow tube and said dye tube at a position at which the retainer rings are securely affixed to the secondary nozzles, the bushings being mounted inside the retainer rings to rotatably support the shaft, the caps fitting over the bushings.

* * * * *